US005604716A

United States Patent [19]

Cheung

[11] Patent Number: 5,604,716

[45] Date of Patent: Feb. 18, 1997

[54] BLACK LIGHT ILLUMINATED ANALOG WATCH

[76] Inventor: James Cheung, 37-48 78th St., Jackson Heights, N.Y. 11372

[21] Appl. No.: 363,638

[22] Filed: Dec. 22, 1994

[51] Int. Cl.[6] ..... G04B 19/30

[52] U.S. Cl. ..... 368/67; 368/226; 368/227

[58] Field of Search ..... 368/67, 83, 226, 368/227, 241

[56] References Cited

U.S. PATENT DOCUMENTS

| | | | |
|---|---|---|---|
| 1,994,950 | 3/1935 | Hoffritz . | |
| 2,680,813 | 6/1954 | Doyle | 368/226 |
| 2,823,512 | 2/1958 | Le Van | 368/226 |
| 3,452,538 | 7/1965 | Frey | 368/227 |
| 3,576,099 | 4/1971 | Walton . | |
| 3,722,206 | 5/1973 | Berget . | |
| 3,736,742 | 6/1973 | Mabuchi et al. . | |
| 3,748,456 | 7/1973 | Brien . | |
| 3,841,083 | 10/1974 | Berget . | |
| 3,851,460 | 12/1974 | Piquerez . | |
| 4,705,407 | 11/1987 | Brien | 368/67 |
| 4,775,964 | 10/1988 | Alessio et al. . | |

FOREIGN PATENT DOCUMENTS

| | | | |
|---|---|---|---|
| 60-179683 | 9/1985 | Japan | 368/227 |

*Primary Examiner*—Vit W. Miska
*Attorney, Agent, or Firm*—Michael I. Kroll

[57] ABSTRACT

A black light illuminated analog watch that contains an ultraviolet light emitting tube. This tube is contained in the inner periphery of a conventional analog watch case. Various components of the watch, including the watch hands, the dial, the watch glass, and others, are coated with a visible light emitting phosphor that is energized by the tube. The phosphors may be selected to glow with different colors. The watch contains circuitry needed to power the tube.

1 Claim, 2 Drawing Sheets

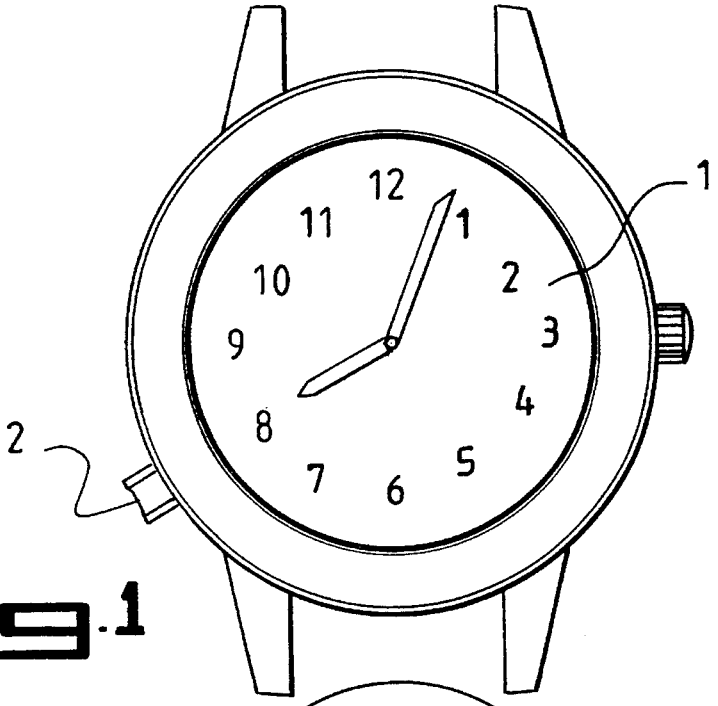
Fig. 1
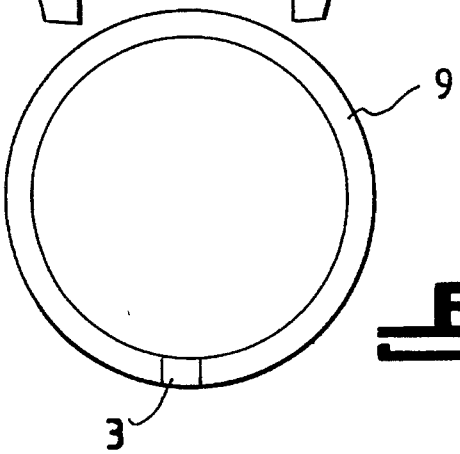
Fig. 2
Fig. 3
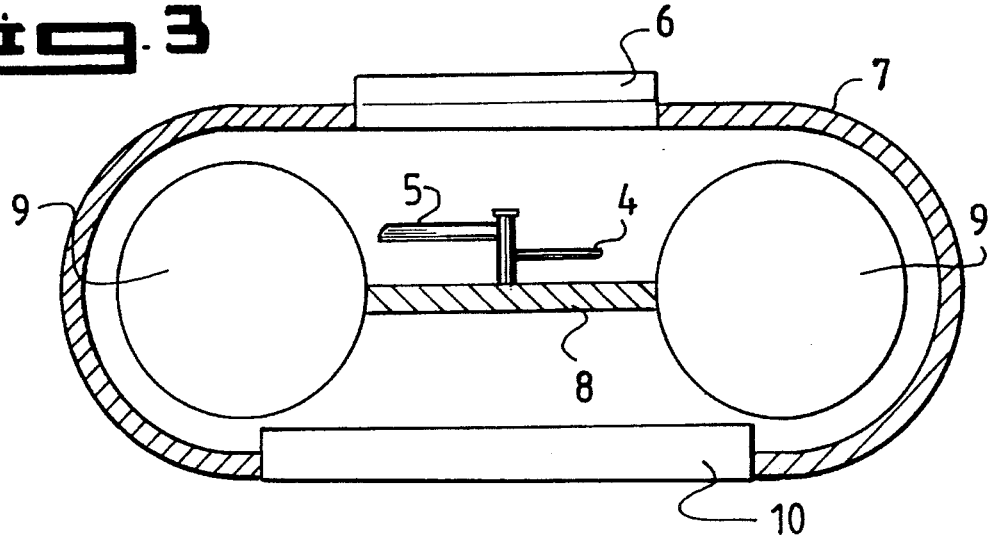

BLACK LIGHT ILLUMINATED ANALOG WATCH

BACKGROUND OF THE INVENTION

The instant inventions relates, generally, to the field of timepieces, and, more specifically, to watches with internal sources of illumination. Watches need to be read under varying levels of ambient lighting. At high lighting levels no internal illumination is required; however, at lower levels, the watch may require some source of internal illumination. A number of internal illumination schemes have been proposed. For example, R. Alessio, et. al. (U.S. Pat. No. 4,775,964) proposes an electroluminescent dial for analog watch and process for making it. This scheme propose a source of backlighting that only illuminates the watch dial itself and only in one color. C. Hoffritz (U.S. Pat. No. 1,994,950) proposes an illuminated dial using a neon tube. This scheme again provides monochromatic light that illuminates all the watch components equally and provides no contrast between components. A. Brien (U.S. Pat. No. 3,748,456) proposes illuminated instrument dials. This scheme uses a circular visible light lamp which again illuminates all the watch components equally and provides no contrast between components.

A better solution to watch illumination would permit each of the watch components, including the dial, hands, watch glass, and graphics to be illuminated in independent colors with good contrast.

SUMMARY OF THE INVENTION

It is, therefore, a primary object of the present invention to provide a black light illuminated analog watch which employs an ultraviolet light emitting tube to illuminate the watch components.

Another object is to provide a black light illuminated analog watch that contains components that are coated with a phosphor coating such that the coating glows when ultraviolet light is incident upon the component.

A further object is to provide a black light illuminated analog watch where various components and graphics elements can have phosphor coatings that emit different color visible light so that, for instance, the clock dial can glow green, and the hands can glow orange.

A still further object is to provide a black light illuminated analog watch where the ultraviolet light emitting tube is hidden from view.

A still further object is to provide a black light illuminated analog watch where the phosphor coating is invisible in normal ambient light so that the coated element is normally invisible, but becomes visible when illuminated by the ultraviolet light emitting tube.

Another object is to provide a black light illuminated analog watch that is simple to use and easy to fabricate at low cost.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a front view of the invention.

FIG. 2 is a schematic view of the ultraviolet light emitting tube.

FIG. 3 is a cross sectional view of the invention.

PARTS LIST

Figure 4:
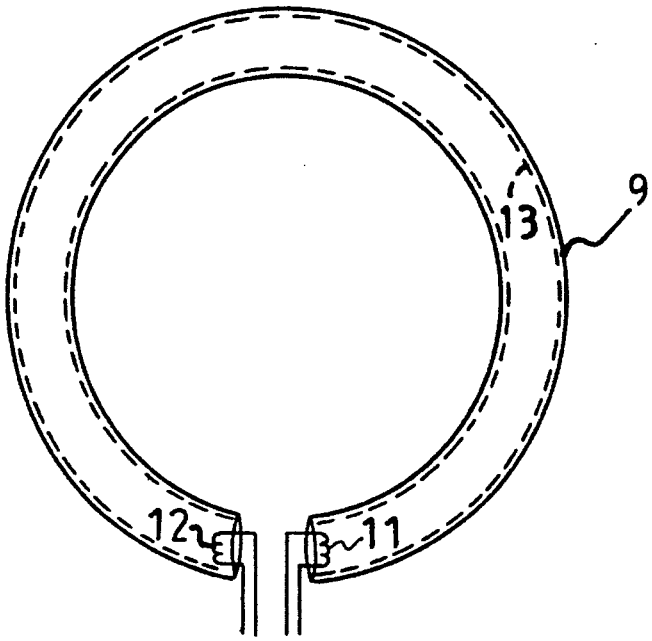
FIG. 4 is a detailed view of the ultraviolet light emitting tube, shown in its circular configuration, illustrating the internal components of the tube.

| Numeral | Description |
|---|---|
| 1 | Watch Dial |
| 2 | Momentary Push Button Switch |
| 3 | Closed Ended Lamp |
| 4 | Hour Hand |
| 5 | Minute Hand |
| 6 | Watch Glass |
| 7 | Watch Casing |
| 8 | Dial |
| 9 | Circular Black Light Tube |
| 10 | Underneath Casing Lid |
| 11 | Filament |
| 12 | Filament |
| 13 | UV-emitting Phosphor |
| 14 | Battery |
| 15 | Inverter |
| 16 | Transformer Primary |
| 17 | Transformer Low Voltage Secondary #1 |
| 18 | Transformer Low Voltage Secondary #2 |
| 19 | Transformer High Voltage Secondary |
| 20 | Semicircular Black Light Tube |
| 21 | Filament |
| 22 | Filament |
| 23 | UV-emitting Phosphor |

DETAILED DESCRIPTION OF THE PREFERRED EMBODIMENTS

The watch dial 1 is illuminated when momentary push button 2 is depressed. The illumination is provided by an ultraviolet light emitting tube 9. Tube 9 contains filaments 11 and 12 that, when heated by an electric current emit thermionic electrons. When a high voltage is impressed between filaments 11 and 12, a pressurized gas in the tube becomes ionized and allows a stream of electrons to flow between the filaments. UV-emitting phosphor 13 emits ultraviolet light when the electrons in the outer orbit of the phosphor atoms, return to their normal energy levels after having been raised to a higher level by incident electrons.

Figure 6:
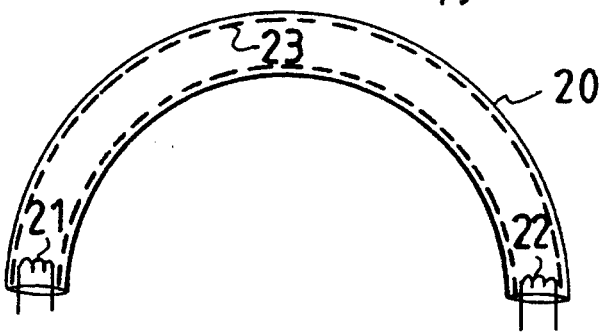
FIG. 6 is a detailed view of the ultraviolet light emitting tube, shown in its semicircular configuration, illustrating the internal components of the tube.

The physical construction of the invention can best be understood with reference to FIG. 3 which shows the watch in cross section. The watch components are contained in watch casing 7. The visible clock components are viewed through watch glass 6, while removable access to the internals of the watch are provided by underneath casing lid 10. The ultraviolet light emitting tube 9 follows the contour of the inside of watch case 7. Typically the tube 9 is circular (see Figure or semicircular (see FIG. 6), but may be any shape. Conventional analog watch components dial 8, minute hand 5, and hour hand 4 are also shown.

Figure 5:
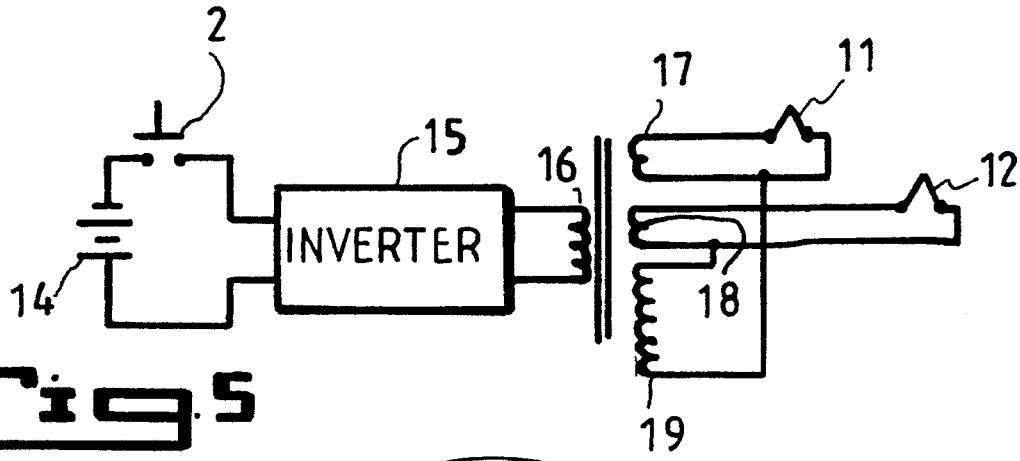
FIG. 5 is an electronic schematic diagram illustrating the circuitry required to energize the ultraviolet light emitting tube.

The ultraviolet light emitting tube 9 requires a source of high voltage and a source of low voltage for the filaments. The circuitry that provides these voltages is illustrated in FIG. 5. A battery 14 provides power. When momentary push button switch 2 is depressed, power is supplied to inverter 15 that converts the dc from battery 14 to the ac that is required by the transformer. The output of inverter 15 is input to the primary winding 16 of the transformer. The transformer has three secondary windings. Low voltage filament windings 17 and 18 are electrically isolated from each other and are used to provide low voltage to filaments 11 and 12 respectively. The output of high voltage winding 19 is impressed across the gap between filaments 17 and 18 prying the high voltage needed to ionize the gas contained in tube 9.

In operation, the various components can be coated individually and separately with visible light emitting phosphors to produce the desired lighting effects. The coating can be selected to produce various colors. Also, the coating can be visible in normal ambient light or invisible. If it is invisible, the coating will only be seen in the presence of ultraviolet light. Components that may be so coated include, but are not limited to, the dial 8, the clock hands 4 and 5, and the watch glass 6.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A black light illuminated analog watch comprising:

a. an analog wrist watch comprising a watch casing, a dial having hour and minute hands mounted within said casing, and a portion of said casing being open and covered with a transparent watch glass for viewing said dial and hour and minute hands;

b. means for emitting ultraviolet light comprising an extended fluorescent tube coated on the inside of said tube with UV-emitting phoshor, said tube mounted within and following the inside contour of and spaced from said casing and extending around said dial so that ultraviolet light from said fluorescent tube when energized falls directly and without any interference on said dial and hour and minute hands, said fluorescent tube being circular in cross section and filling substantially the full annular space between the dial face and the side wall of said casing and throwing light directly on the face of said dial and the surfaces of said hour and minute hands visible through said transparent watch glass;

c. visible portions of said dial and hour and minute hands being coated with visible light emitting phosphor, said phosphor coated portions glowing and visible through said transparent watch glass when ultraviolet light from said fluorescent tube is incident upon said dial and hour and minute hands; and d. means within said casing for supplying high voltage to said fluorescent tube comprising a battery, an inverter to convert dc from said battery to ac, step-up transformer means to output a voltage high enough to energize said fluorescent tube, and momentary push button switch means to provide momentary lighting of said dial and hour and minute hands when it is desired to read the time when ambient light is insufficient to permit said reading.

* * * * *